US010494816B2

(12) United States Patent
Sorkin

(10) Patent No.: US 10,494,816 B2
(45) Date of Patent: Dec. 3, 2019

(54) SHEATHING PULLER

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 148 days.

(21) Appl. No.: 15/730,178

(22) Filed: Oct. 11, 2017

(65) Prior Publication Data

US 2018/0106040 A1 Apr. 19, 2018

Related U.S. Application Data

(60) Provisional application No. 62/407,612, filed on Oct. 13, 2016.

(51) Int. Cl.

| | |
|---|---|
| ***E04C 5/08*** | (2006.01) |
| ***E04C 5/12*** | (2006.01) |
| ***E04C 5/10*** | (2006.01) |
| ***E04C 5/16*** | (2006.01) |
| *E04G 21/12* | (2006.01) |

(52) U.S. Cl.

CPC ..... *E04C 5/12* (2013.01); *E04C 5/10* (2013.01); *E04C 5/165* (2013.01); *E04G 21/12* (2013.01)

(58) Field of Classification Search

CPC ... E04C 5/12; E04C 5/10; E04C 5/165; E04C 5/127; E04C 5/125; E04C 5/122; Y10T 29/53213; Y10T 29/5137; Y10T 29/49874; Y10T 29/53696; Y10T 29/49838; E04G 21/12; E04G 21/122; H01R 43/28; H01R 43/01; E02D 5/50

USPC ..... 52/223.14; 29/564.1, 748, 749

See application file for complete search history.

(56) References Cited

U.S. PATENT DOCUMENTS

| | | | | |
|---|---|---|---|---|
| 3,022,713 A | | 2/1962 | Friberg | |
| 3,038,754 A | | 6/1962 | Peterson | |
| 3,719,982 A | | 3/1973 | Tindal | |
| 3,768,143 A | * | 10/1973 | Holmes, Jr. ..... | H02G 1/1248 29/867 |
| 3,785,617 A | * | 1/1974 | Friedrich ..... | E02D 5/808 254/1 |
| 3,875,662 A | * | 4/1975 | Folk ..... | H01R 43/052 29/863 |
| 3,952,999 A | | 4/1976 | Keller et al. | |
| 4,095,326 A | | 6/1978 | Harvey | |

(Continued)

OTHER PUBLICATIONS

Extended European Search Report issued in EP App. No. 17196169.1-1005 dated Feb. 21, 2018 (10 pages).

*Primary Examiner* — Chi Q Nguyen
(74) *Attorney, Agent, or Firm* — Adolph Locklar

(57) ABSTRACT

A sheathing puller for use in a concrete post-tensioning system that includes at least one anchor assembly and a tension member comprising a cable and a sheath surrounding the cable, comprises a stationary coupler, a force applicator mechanically coupled to the stationary coupler, and a sheathing gripper mechanically coupled to the force applicator and configured to grip the sheath. Actuation of the force applicator may cause the sheathing gripper to grip the sheath and apply a longitudinal force thereto. The sheathing stationary coupler may be configured to engage the at least one anchor and the force applicator may be a pulley, screw, ratchet, bar clamp, pipe clamp, or screw clamp. Also disclosed is a method for mechanically coupling the stationary coupler to a fixed object, mechanically coupling the sheathing gripper to the sheath, and sliding the sheath along the tension member using the sheathing puller.

15 Claims, 13 Drawing Sheets

(56) References Cited

U.S. PATENT DOCUMENTS 4,310,967 A * 1/1982 Funcik ..... H01R 43/01 29/564.1
4,488,353 A * 12/1984 Caveney ..... H01R 43/01 29/749
4,856,254 A 8/1989 Jungwirth
4,896,470 A 1/1990 Sorkin
4,928,066 A * 5/1990 Adlon ..... G01R 31/021 324/539
5,072,558 A 12/1991 Sorkin et al.
5,370,237 A * 12/1994 Anderson ..... H01R 43/01 209/556
5,440,842 A 8/1995 Sorkin
5,522,691 A * 6/1996 Anderson ..... H01R 43/01 414/781
5,701,707 A 12/1997 Sorkin
5,720,139 A 2/1998 Sorkin
5,749,185 A 5/1998 Sorkin
5,755,065 A 5/1998 Sorkin
5,770,286 A 6/1998 Sorkin
5,788,398 A 8/1998 Sorkin
5,839,235 A 11/1998 Sorkin
5,897,102 A 4/1999 Sorkin
6,012,867 A 1/2000 Sorkin
6,017,165 A 1/2000 Sorkin
6,023,894 A 2/2000 Sorkin
6,027,278 A 2/2000 Sorkin
6,098,356 A 8/2000 Sorkin
6,151,850 A 11/2000 Sorkin
6,176,051 B1 1/2001 Sorkin
6,234,709 B1 5/2001 Sorkin
6,381,912 B1 5/2002 Sorkin
6,393,781 B1 5/2002 Sorkin
6,513,287 B1 2/2003 Sorkin
6,560,939 B2 5/2003 Sorkin
6,631,596 B1 10/2003 Sorkin
6,658,719 B2 * 12/2003 Thoms ..... H02G 1/1256 140/149
6,761,002 B1 7/2004 Sorkin
6,817,148 B1 11/2004 Sorkin
6,843,031 B1 1/2005 Sorkin
7,424,792 B1 9/2008 Sorkin
7,614,134 B2 * 11/2009 Messein ..... B25D 9/11 173/90
7,676,997 B1 3/2010 Sorkin
D615,219 S 5/2010 Sorkin
7,797,894 B1 9/2010 Sorkin
7,797,895 B1 9/2010 Sorkin
7,823,345 B1 11/2010 Sorkin
7,841,061 B1 11/2010 Sorkin
7,841,140 B1 11/2010 Sorkin
7,856,774 B1 12/2010 Sorkin
7,866,009 B1 1/2011 Sorkin
7,900,344 B2 * 3/2011 Ng ..... H01R 43/0207 29/709
7,950,196 B1 5/2011 Sorkin
7,950,197 B1 5/2011 Sorkin
8,015,774 B1 9/2011 Sorkin
8,065,845 B1 11/2011 Sorkin
8,069,624 B1 12/2011 Sorkin
8,082,664 B2 * 12/2011 Dohmen ..... H01R 43/28 29/33 M
8,087,204 B1 1/2012 Sorkin
8,251,344 B1 8/2012 Sorkin
8,702,063 B2 4/2014 Degasne et al.
8,984,745 B2 * 3/2015 Paynter ..... H01R 43/02 29/828
9,097,014 B1 8/2015 Sorkin
2017/0037625 A1 2/2017 Sorkin
2017/0037626 A1 2/2017 Sorkin

* cited by examiner

SHEATHING PULLER

CROSS-REFERENCE TO RELATED APPLICATIONS

This application is a non-provisional application which claims priority from U.S. provisional application No. 62/407,612, filed Oct. 13, 2016, which is incorporated by reference herein in its entirety.

TECHNICAL FIELD/FIELD OF THE DISCLOSURE

The present disclosure relates generally to post-tensioned, pre-stressed concrete construction.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, sports courts, and other structures.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a tension member is tensioned after the concrete has attained a desired strength by use of a post-tensioning tendon. The post-tensioning tendon may include for example and without limitation, anchor assemblies, the tension member, and sheaths.

Traditionally, a tension member is constructed of a material that can be elongated and may be a single or a multi-strand cable. The tension member may be formed from a metal, such as reinforced steel. The tension member is encapsulated within a polymeric sheath hot extruded thereabout to form an encapsulated tension member. The sheath may prevent or retard corrosion of the tension member by restricting exposure of the tension member to corrosive or reactive fluids. Further, the sheath may prevent or retard concrete from bonding to the tension member. The sheath may be filled with grease. Because the tension member and the polymeric sheath are formed from different materials, the thermal expansion and contraction rates of the tension member and polymeric sheath may differ. When the encapsulated tension members are coiled for transport and storage, uneven thermal contraction may occur as the tendon cools. When installed as part of the post-tensioning tendon in a pre-stressed concrete member, cooling of the sheath may cause separation of the sheath from an anchorage, potentially exposing the tension member to corrosive or reactive fluids.

The post-tensioning tendon traditionally includes an anchor assembly at each end. The tension member is fixedly coupled to a fixed anchor assembly positioned at one end of the post-tensioning tendon, the "fixed-end", and stressed at the stressed anchor assembly positioned at the opposite end of the post-tensioning tendon, the "stressing-end" of the post-tensioning tendon.

When coupling the tension member to the stressed anchor assembly positioned at the stressing-end of the post-tensioning tendon, the sheath at the stressing-end is retained within the stressed anchor assembly, such as, for instance, by coupling the sheath within a sheathing retainer. Examples of sheathing retainers include a sheathing lock and a sheathing retention capsule. The sheathing retainer holds the sheathing in the stressed anchor assembly, such as through the use of wedges. During installation, the sheath may be decoupled from or improperly coupled to the sheathing retainer. For example, decoupling or improperly coupling to the sheathing retainer may be caused by: (1) cutting a portion of the sheathing to expose a portion of the strand, where the sheath is cut too short to couple with the sheathing retainer; (2) applying tension applied to the sheath, resulting in shrinkage of the length of the sheath over time; or (3) applying force applied to the sheath causing stretching of the sheath, or shortening of the sheath. During installation, tension may be applied to the sheath from stepping on the sheath or impact by tools or heavy equipment. Traditionally, solutions for a sheath that is too short or is otherwise decoupled from the sheathing retainer include applying tape about the unsheathed portion of the tension member, or splicing additional sheath onto the existing sheath.

SUMMARY

The present disclosure provides for a sheathing puller. The sheathing puller includes a stationary coupler and a force applicator mechanically coupled to the stationary coupler. The sheathing puller also includes a sheathing gripper mechanically coupled to the force applicator.

The present disclosure also provides for a post-tensioning system comprising a fixed object and an encapsulated tension member, the encapsulated tension member including a tension member and a sheath. The tension member is encapsulated by the sheath. The post-tensioning system includes a sheathing puller, which in turn includes a stationary coupler that is mechanically coupled to the fixed object. The sheathing puller also includes a force applicator that is mechanically coupled to the stationary coupler and a sheathing gripper that is mechanically coupled to the force applicator and grips or engages the sheath.

The stationary coupler may comprise a coupling body configured to engage the at least one anchor. The force applicator may be a pulley, screw, ratchet, bar clamp, pipe clamp, or screw clamp or may comprise a linear actuator that is mechanically coupled to the stationary coupler and a sliding head that is coupled to the linear actuator and mechanically coupled to the sheathing gripper. The linear actuator may be a hydraulic linear actuator, a pneumatic linear actuator, an electro-mechanical linear actuator, or a linear motor or a mechanical linear actuator comprising a screw, chain drives, belt drives, rigid chains, and/or a rigid belt.

The sheathing gripper may include a cable-receiving channel and at least one gripping member that is pivotable into engagement with a cable that is positioned in the cable-receiving channel. Actuation of the force applicator may cause the sheathing gripper to grip the sheath and apply a longitudinal force thereto.

The present disclosure also provides for a method. The method includes providing an encapsulated tension member including a tension member and a sheath positioned about the tension member. In addition, the method includes providing an anchor that includes a sheathing retainer, a sheathing puller that includes a stationary coupler, and a force applicator that is mechanically coupled to the stationary coupler. The sheathing puller also includes a sheathing gripper that is mechanically coupled to the force applicator. The method also includes mechanically coupling the stationary coupler to a fixed object and mechanically coupling the sheathing gripper to the sheath. In addition, the method includes sliding the sheath along the tension member using the sheathing puller.

The method may further comprise coupling the sheathing retainer to the sheath. Actuating the force applicator may cause the sheathing gripper to grip the sheath and apply a longitudinal force thereto. The sheathing gripper may include a cable-receiving channel and at least one gripping member that is pivotable into engagement with a cable that is positioned in the cable-receiving channel. The force applicator may comprise a stationary head, a linear actuator mechanically coupled to the stationary head, and a sliding head slideably coupled to the linear actuator and wherein the step of sliding the sheath along the tension member using the sheathing puller comprises mechanically urging the sliding head towards the stationary head using the linear actuator.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
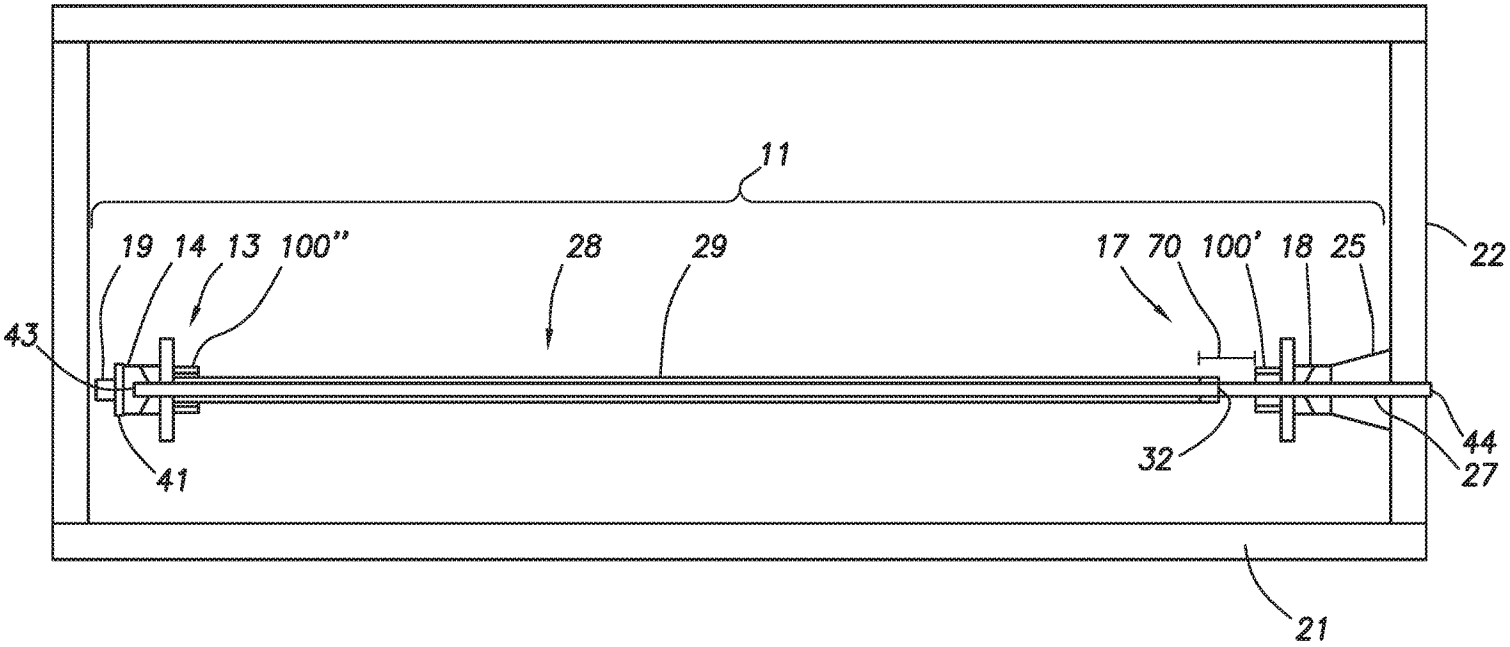
FIG. 1 depicts a top view of a post-tensioning tendon within a concrete form, where a sheath is decoupled from a sheathing retainer.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a top view of a post-tensioning tendon 11 within a concrete form 21. Post-tensioning tendon 11 may include a fixed end anchor 13, a tendon 28 comprising an encapsulated tension member 27 (sometimes also referred to as a cable or strand), a sheath 29 surrounding tension member 27, and a stressing end anchor 17 including a sheathing retainer 100'. Tension member 27 may be a single or multi-strand cable, such as a single or multi-strand metal cable. Sheath 29 may be tubular or generally tubular and may be positioned about tension member 27. In some embodiments, space between tension member 27 and sheath 29 may be filled or partially filled with a filler such as grease. As shown in FIG. 1, post-tensioning tendon 11 may be positioned within concrete form 21 prior to pouring concrete into form 21.

In some embodiments, fixed end anchor 13 may include a fixed end anchor body 14 and a sheathing retainer 100", which may be positioned within concrete form 21 such that fixed end anchor body 14 and sheathing retainer 100" will be encased in concrete when concrete is poured into concrete form 21. In some embodiments, a fixed end cap 19 may be positioned at distal end 41 of fixed end anchor body 14. Fixed end cap 19 may, in certain embodiments, protect encapsulated tension member 27 from corrosion after concrete is poured by preventing or retarding corrosive fluids, reactive fluids, or concrete from contacting tension member 27.

Stressing end anchor 17 may be positioned within concrete form 21 and may include a stressing end anchor body 18. In certain embodiments, a pocket former 25 may be positioned between stressing end anchor body 18 and an end wall 22 of concrete form 21.

When installing tendon 28, in some embodiments, a length of sheath 29 may be removed from a first end 43 of tendon 28, exposing a portion of tension member 27. Tension member 27 may be inserted through fixed end anchor 13 until sheath 29 engages with sheathing retainer 100". Sheathing retainer 100" and sheathing retainer 100', located proximate stressing end anchor 17, may each comprise any structure adapted to grip, hold, and/or retain sheath 29. In some embodiments, sheathing retainers 100', 100" may grip, hold, and/or retain sheath 29 via frictional force or pressure fit. For example and without limitation, sheathing retainer 100', 100" may be a sheathing retention capsule as described U.S. patent application Ser. No. 15/226,528, filed Aug. 2, 2016, a sheathing retention assembly as describe in U.S. patent application Ser. No. 15/226,594, filed Aug. 2, 2016, a wedge as described in U.S. Pat. No. 7,866,009, issued on Jan. 11, 2011, a sheathing lock as described in U.S. Pat. No. 8,065,845, issued on Nov. 29, 2011, or a fixing means as described in U.S. Pat. No. 7,841,140, issued on Nov. 30, 2010, each of which disclosures is hereby incorporated by reference in its entirety.

Although described hereinafter with respect to fixed end anchor 13 and sheathing retainer 100", the present disclosure applies equally to stressing end anchor 17 and sheathing retainer 100'.

In some embodiments, sheathing retainer 100" may be mechanically coupled to fixed end anchor 13. Sheathing retainer 100" may mechanically couple to fixed end anchor 13 and stressing end anchor 17 by a retainer coupler, including but without limitation a thread, detent, press lock, tab-and-slot connection, or a combination thereof. In some embodiments, sheathing retainer 100" may be a sheathing retention capsule including one of one or more holding wedges having an inner wall with a diameter corresponding with outer diameter 32 of sheath 29, such as the sheathing retention capsules described in U.S. patent application Ser. No. 15/226,528. In such embodiments, the inner wall of the holding wedges may form a press or friction fit when sheath 29 is inserted into sheathing retainer 100". The press or friction fit may be formed by, for example and without limitation, surface features on the inner wall of such holding wedges that increase the static friction between sheath 29 and sheathing retainer 100". The surface features may include grooves, protrusions, or teeth that may contact sheath 29 and, in some embodiments, press against or into sheath 29, thus increasing the retention force between sheathing retainer 100" and sheath 29.

In some embodiments, sheathing retainer 100" may include seals positioned to seal between sheath 29 and fixed end anchor 13. Such seals may be annular or generally annular and may fit into a recess formed in fixed end anchor 13. The seals may protect tension member 27 from corrosion after concrete 23 is poured and may prevent or restrict concrete 23 from ingressing into tension member 27. Although described herein as a separate component from fixed end anchor 13, sheathing retainer 100" may alternatively be formed as a part of fixed end anchor 13.

In some installations, tension member 27 may be mechanically coupled to fixed end anchor 13, such as by the use of wedges, and positioned within concrete form 21. Tension member 27 may be cut to correspond with the length of concrete form 21. In some embodiments, a length of sheath 29 may be removed from tension member second end 44 of tension member 27, exposing tension member 27 at second end 44. Tension member 27 may be inserted through stressing end anchor 17.

As depicted in FIG. 1, during or after installation of tension member 27, sheath 29 may become decoupled from or improperly coupled to sheathing retainer 100', such that sheath 29 is separated from sheathing retainer 100' by distance 70 and sheath 29 is no longer retained by sheathing retainer 100'. While sheath 29 is shown decoupled from sheathing retainer 100' at stressing end anchor 17, sheathing puller 1000, as described hereinbelow, may likewise be used in conjunction with a decoupling of sheath 29 from sheathing retainer 100" at fixed end anchor 13.

Figure 2:
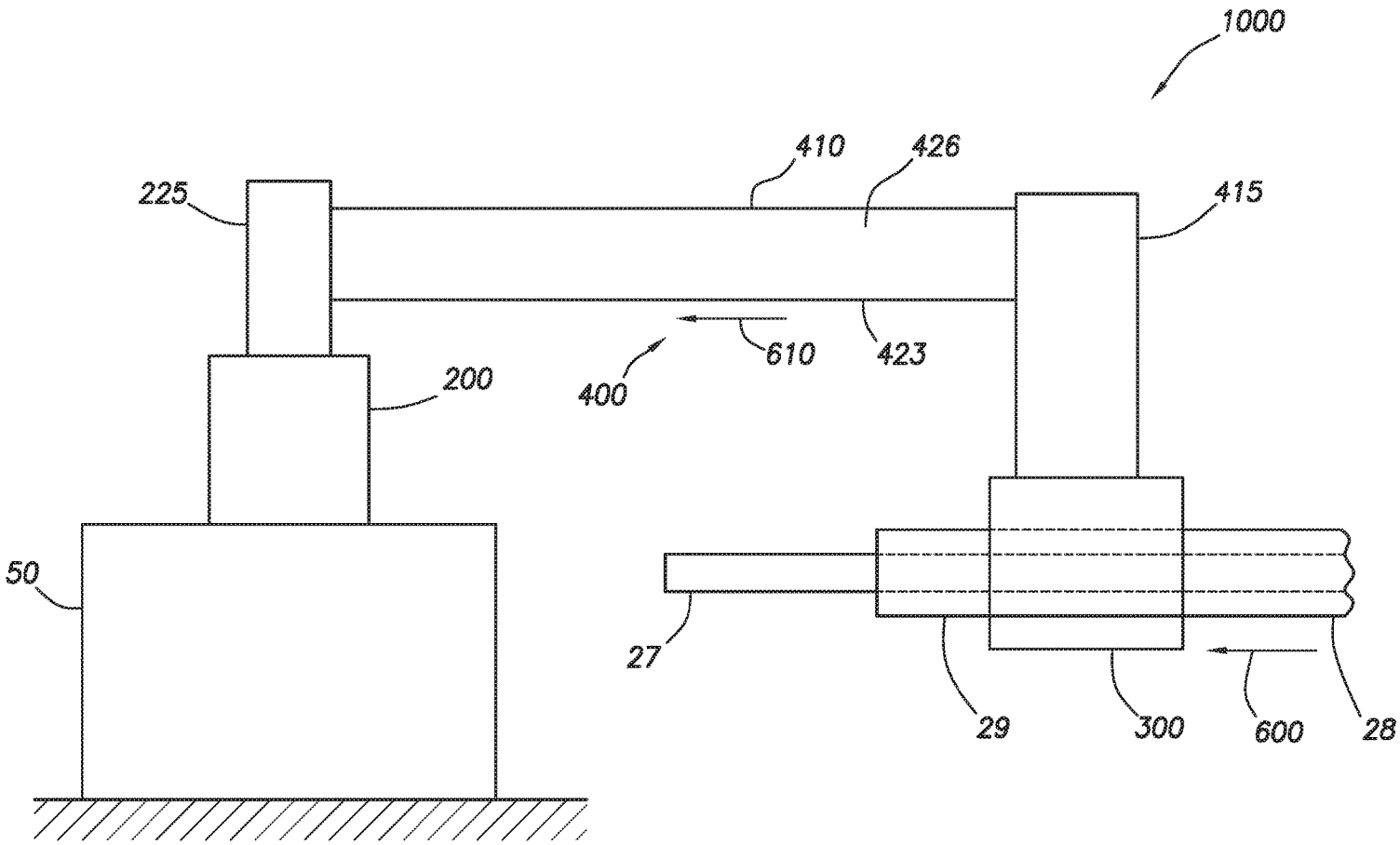
FIG. 2 is a block diagram of a sheathing puller coupled to a fixed object and a sheath consistent with at least one embodiment of the present disclosure.

In certain embodiments of the present disclosure, a sheathing puller 1000 may be employed to recouple sheath 29 to sheathing retainer 100'. FIG. 2 depicts an embodiment of sheathing puller 1000 in conjunction with a fixed object 50 and an encapsulated tension member 27. Sheathing puller 1000 may include a stationary coupler 200, a force applicator 400, and a sheathing gripper 300. Force applicator 400 may include a linear actuator 410, a stationary head 225, and a sliding head 415. Linear actuator 410 may include a camming mechanism and a force transmission member 426, such as a track or bar.

Fixed object 50 may be any object that is static with respect to sliding head 415. Examples of fixed object 50 include, but are not limited to, an anchor, such as fixed end anchor 13 or stressing end anchor 17, a portion of concrete form 21 such as a form board, rebar, or the ground. Stationary coupler 200 may be mechanically coupled to fixed object 50. Stationary coupler 200 may be any device configured to any structure, static or mechanical, configured to grab, grip, hold, mechanically couple with, and/or be affixed sheathing puller 1000 to fixed object 50, including, but not limited to, one or more clamps, straps, bolts, screws, stakes, brackets, or cables.

Still referring to FIG. 2, force applicator 400 may be any mechanical apparatus configured to transfer a longitudinal force so as to mechanically urge sheathing gripper 300 along the cable in the direction indicated by 600. Force applicator 400 may comprise or include, for example and without limitation, one or more of a pulley, a screw, a ratchet, a bar clamp (such as, for instance, a ratchet bar clamp) a pipe clamp, or a screw clamp.

In certain embodiments, and as shown in FIG. 2, stationary head 225 may be mechanically coupled to stationary coupler 200. Stationary head 225 is configured to remain static with respect to sliding head 415 as stationary head 225 is coupled through stationary coupler 200 to fixed object 50. Stationary head 225 may be any mechanical coupling, and may include, for instance, a bar, screw, strap, bolt, or bracket.

Likewise, linear actuator 410 may be any apparatus for mechanically urging sliding head 415 towards stationary head 225, as indicated by arrow 610. Linear actuator 410 may be, but is not limited to, a mechanical linear actuator, a hydraulic linear actuator, a pneumatic linear actuator, an electro-mechanical linear actuator, or a linear motor. Mechanical linear actuators include but are not limited to screws, such as leadscrews, screw jacks, ball screws, and roller screws; chain drives; belt drives; rigid chains; and rigid belts. Hydraulic linear actuators include but are not limited to hydraulic cylinders that may be controlled by hydraulic pumps. Pneumatic linear actuators include but are not limited to pneumatic cylinders that may be controlled by compressed gas. Electro-mechanical linear actuators may include mechanical linear actuators mechanically coupled to an electric motor. In the embodiment depicted in FIG. 2, linear actuator 410 includes a force transmission member 426 coupled to stationary head 225 at a first end and sliding head 415 at a second end.

Linear actuator 410 may be slideably coupled to sliding head 415. As described hereinabove, sliding head 415 is any mechanical apparatus configured to be mechanically urged by linear actuator 410 towards stationary head 225. As shown in FIG. 2, sliding head 415 may slide towards stationary head 225 as indicated by arrow 610.

As further depicted in FIG. 2, sliding head 415 is mechanically coupled to sheathing gripper 300. Sheathing gripper 300 may be any structure, static or mechanical, adapted to grab, grip, hold, mechanically couple with, or otherwise affix to sheath 29. Non-limiting examples of sheathing gripper 300 include one or more clamps, straps, bolts, screws, brackets, or cables.

During operation, stationary coupler 200 may be mechanically coupled to fixed object 50 and sheathing gripper 300 may be affixed to sheath 29. Sheathing puller 1000 may then be employed to slide sheath 29 along tension member 27 in direction 600. The sliding movement of sheath 29 along tension member 27 may be further facilitated by grease within sheath 29. In the embodiment shown in FIG. 2, linear actuator 410 mechanically urges sliding head 415 toward stationary head 225, as at arrow 610. Because sliding head 415 is mechanically coupled to sheathing gripper 300, sheathing gripper 300 is mechanically urged in direction 600 as sliding head 415 is mechanically urged towards stationary head 225.

Figure 3:
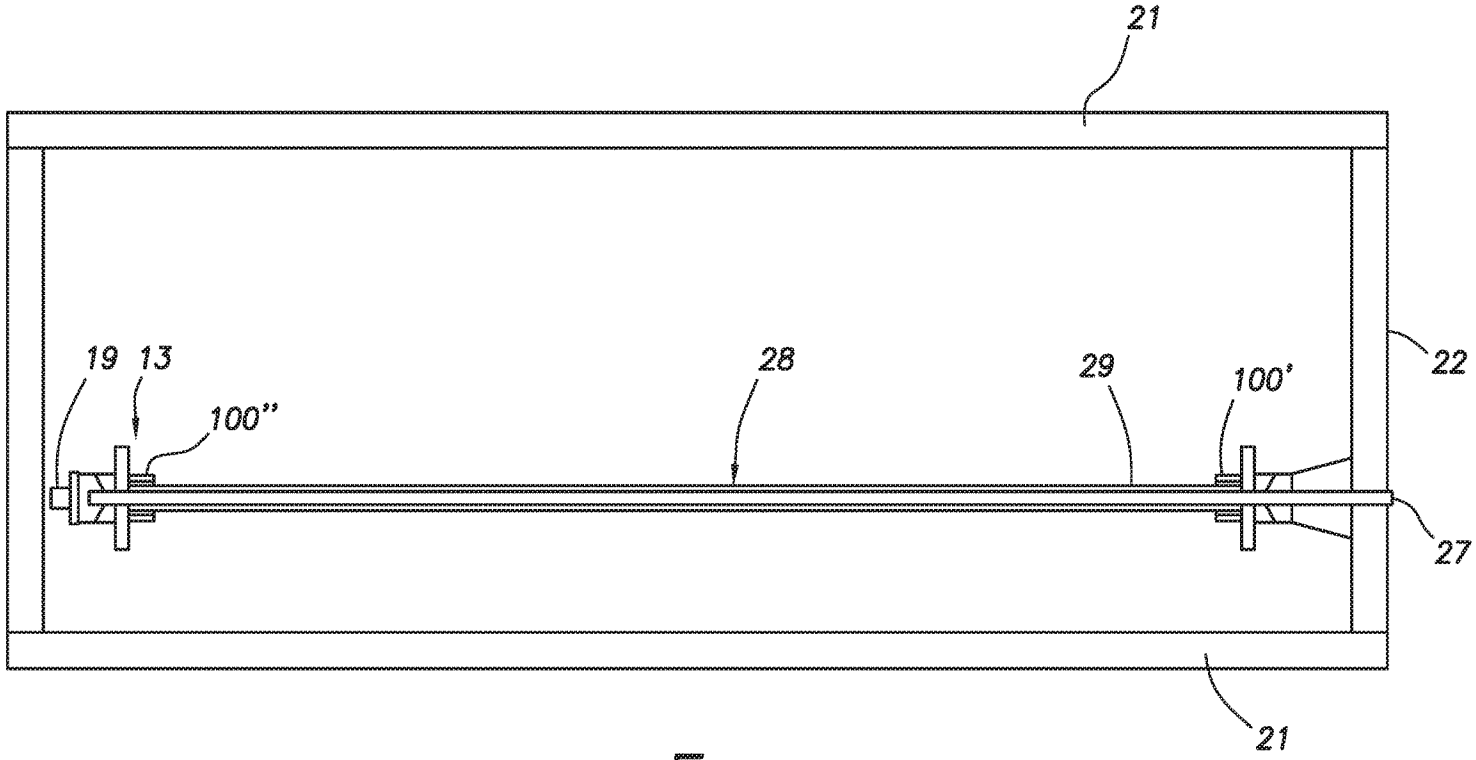
FIG. 3 depicts a top view of a post-tensioning tendon within a concrete form, where a sheath is mechanically coupled to a sheathing retainer consistent with embodiments of the present disclosure.

By sliding sheath 29 along tension member 27, sheath 29 may be brought into proximity to and then coupled or recoupled with sheathing retainer 100', as shown in FIG. 3.

Figure 4:
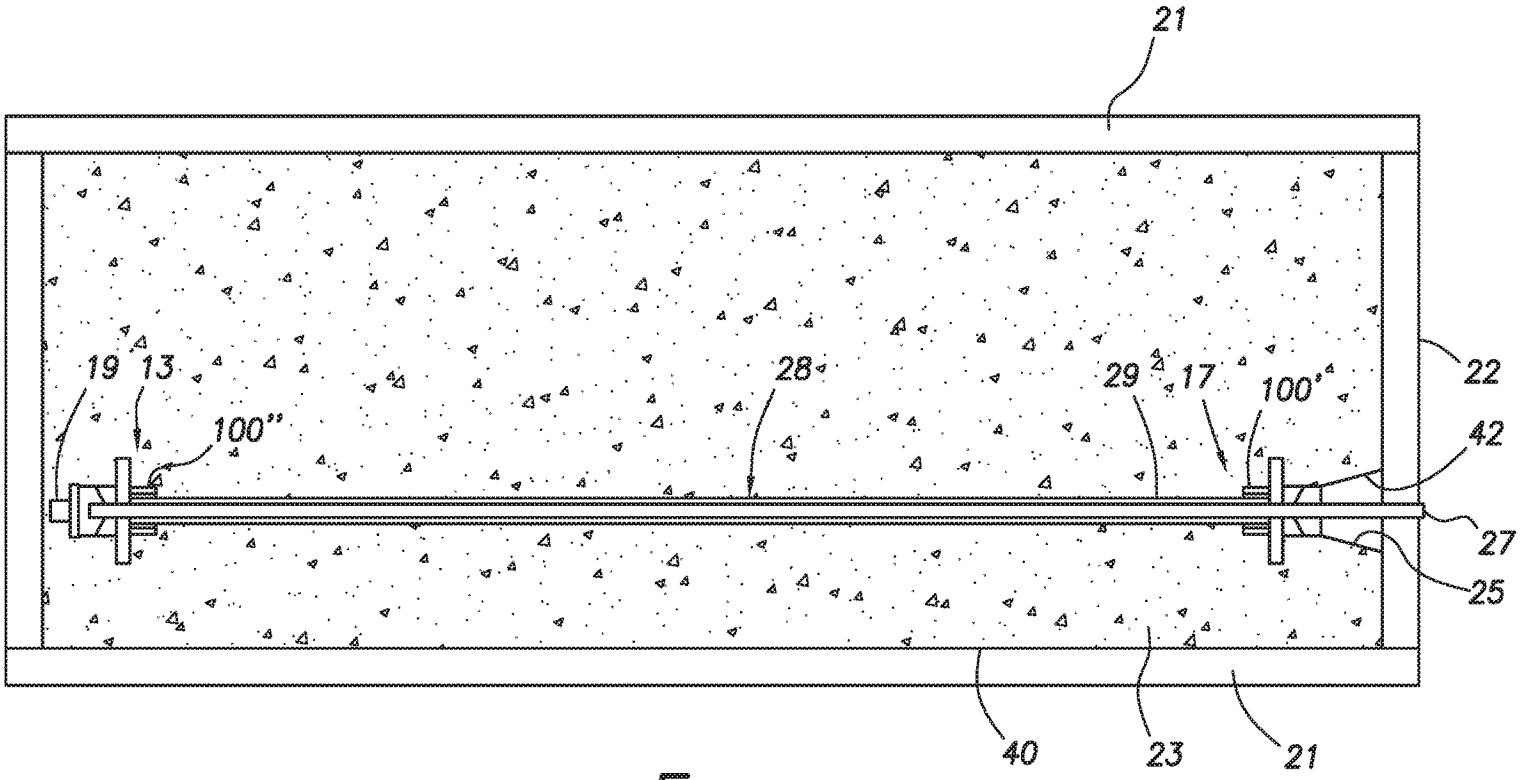
FIG. 4 depicts a top view of a post-tensioning tendon with a concrete member formed within a concrete form consistent with embodiments of the present disclosure.

Once sheathing 29 is coupled or recoupled with sheathing retainer 100, concrete 23 may be poured into concrete form 21 to form a concrete member 40, as depicted in FIG. 4. Stressing end anchor 17 may be positioned within concrete form 21 such that it is substantially surrounded by concrete 23. Pocket former 25 may be adapted to, for example and without limitation, prevent or restrict concrete 23 from filling space between stressing end anchor body 18 and end wall 22, thus forming a cavity or pocket in edge 42 of concrete member 40 formed by concrete 23 within concrete form 21. Pocket former 25 may thus allow access to tension member 27 from outside concrete member 40 once concrete member 40 is sufficiently hardened and end wall 22 is removed.

Figure 5:
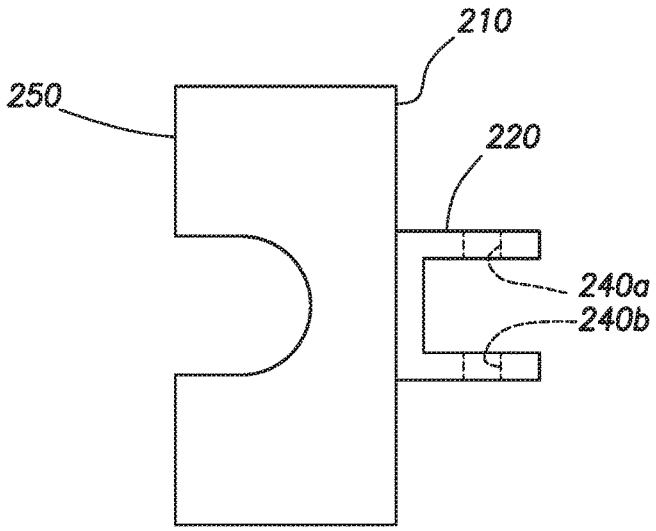
FIG. 5 depicts a side view of a stationary coupler consistent with embodiments of the present disclosure.
Figure 6:
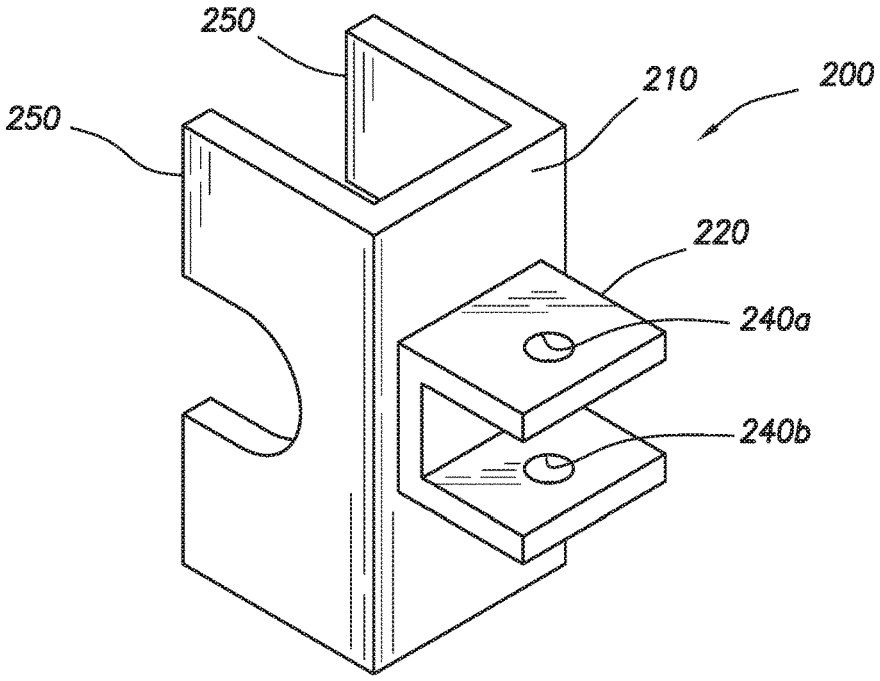
FIG. 6 depicts an orthographic view of the stationary coupler of FIG. 5.

Referring now to FIGS. 5 and 6 a stationary coupler 200 in accordance with certain embodiments of the present disclosure may include a coupling body 210 that includes a stationary head receptacle 220 configured to mechanically couple stationary coupler 200 to force applicator 400. In the embodiment depicted in FIG. 5, stationary head receptacle 220 is configured to receive stationary head 225. Stationary head receptacle 220 may include pin holes 240*a* and 240*b* configured to receive a holding pin (not shown). When stationary head 225 is received within stationary head receptacle 220, a holding pin may be inserted thought pin holes 240*a*, 240*b* to retain stationary head 225 within stationary head receptacle 220.

As further depicted in FIGS. 5 and 6, coupling body 210 may include one or more object receptacles 250. Object receptacles may be configured to mechanically couple stationary coupler 200 to one or more fixed objects 50. While shown in FIGS. 5 and 6 as opposite stationary head receptacle 220, one or more object receptacles 250 may be located anywhere on coupling body 210. Object receptacle 250 is configured to receive all or a portion of fixed object 50. Object receptacle 250 may, for example and without limitation, be configured to straddle a portion of fixed object for mechanical coupling of stationary coupler 200 to fixed object 50. In certain embodiments, such as the embodiment depicted in FIG. 7, object receptacle 250 may straddle an anchor, such as stressing end anchor 17, thereby mechanically coupling stationary coupler 200 thereto.

Figure 7:
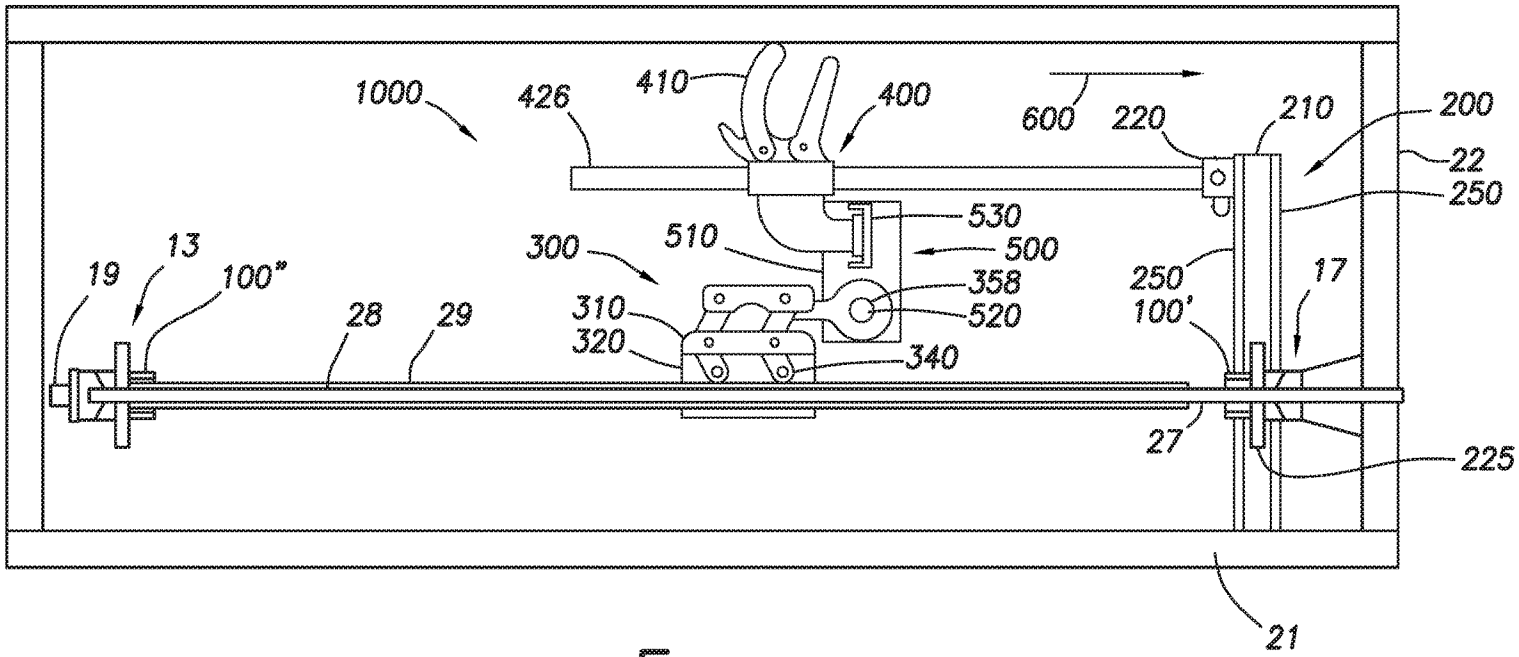
FIG. 7 depicts a top view of a post-tensioning tendon within a concrete form, where a sheathing puller is mechanically coupled to a sheath consistent with embodiments of the present disclosure.
Figure 8:
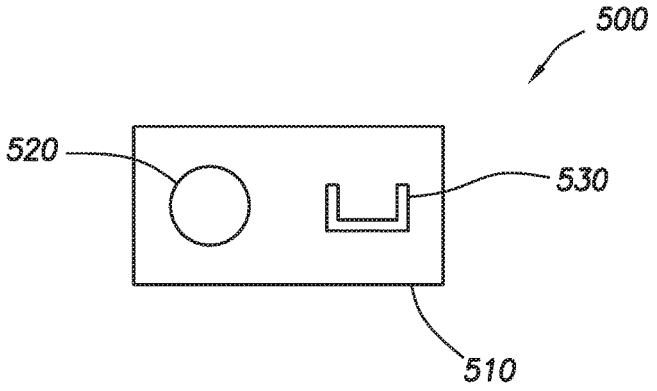
FIG. 8 depicts a top view of a force applicator coupler consistent with embodiments of the present disclosure.
Figure 9:
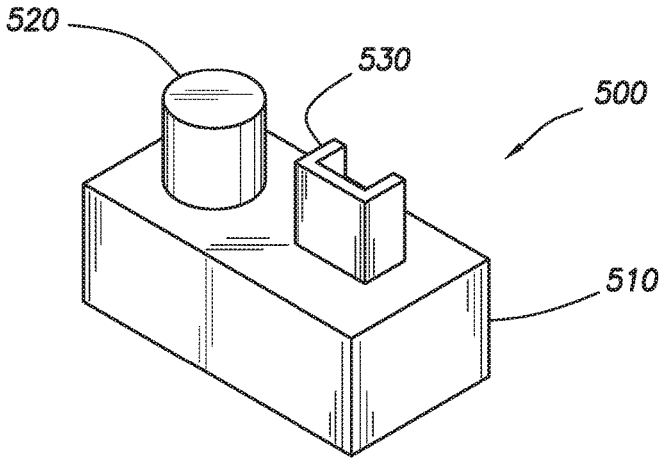
FIG. 9 depicts an orthographic view of the force applicator coupler of FIG. 8.

Referring again briefly to FIG. 2, sheathing gripper 300 may be mechanically coupled to force applicator 400. In certain embodiments, as shown in FIG. 7, sheathing gripper 300 is mechanically coupled to force applicator 400 by a force applicator coupler 500. Force applicator coupler 500 may comprise or include one or more clamps, such as bar clamps, pipe clamps, and screw clamp; straps; bolts; screws; stakes; brackets; or cables. One embodiment of force applicator coupler 500 is shown in FIGS. 8 and 9. As shown in FIGS. 8 and 9, force applicator coupler 500 may include a base 510, a sheathing gripper coupler 520 for mechanically coupling to sheathing gripper 300, and a force applicator coupler 530 for mechanically coupling to force applicator 400.

Figure 10:
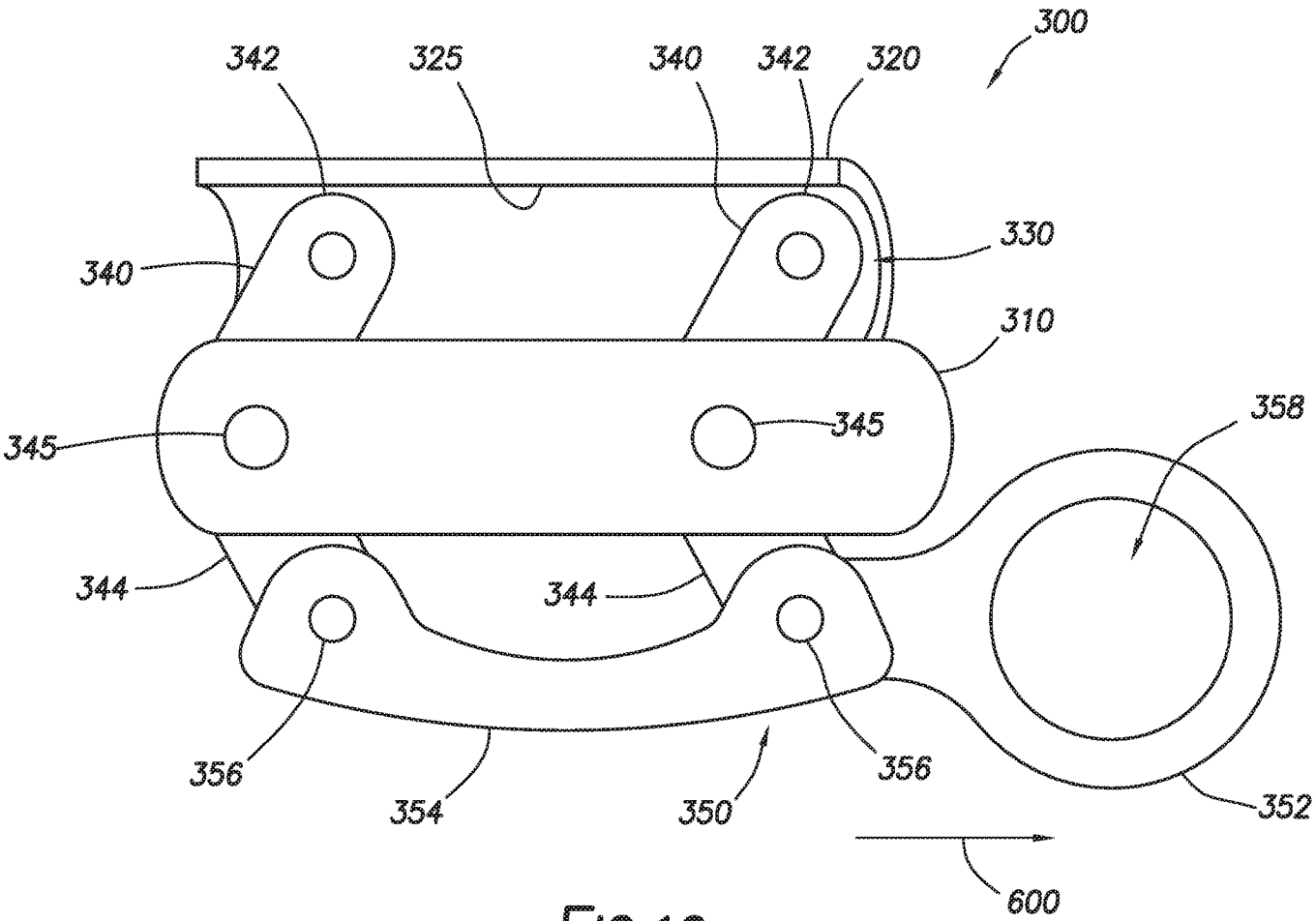
FIG. 10 depicts a sheathing gripper consistent with embodiments of the present disclosure.

FIG. 10 depicts a sheathing gripper 300 in accordance with certain embodiments of the present disclosure. In the embodiment depicted in FIG. 10, sheathing gripper 300 may include a gripper frame 310, including a cable-receiving channel 320 extending therefrom. Cable-receiving channel 320 may include a channel cylindrical surface 325. Channel cylindrical surface 325 may define a channel 330 for receiving sheath 29. One or more gripping members 340 may be pivotably coupled to gripper frame 310. Gripping members 340 may be, for example and without limitation, coupled to gripper frame 310 such as by pinning via pins 345. Each gripping member 340 may be pivotable about one of pins 345 to extend gripping ends 342 of gripping members 340 at least partially into channel 330. Likewise, each gripping member 340 may be pivotable about one of pins 345 to retract gripping ends 342 of gripping members 340 at least partially out of channel 330.

Sheathing gripper 300 may include a handle 350 mechanically coupled to the gripping members 340. Handle 350 may include a tab 352 mechanically coupled to handle a frame 354. Handle frame 354 may be mechanically coupled to gripping members 340, such as via one or more pins 356, which may be mechanically coupled to handle frame 354 and handle ends 344 of gripping members 340. Tab 352 may include a through-hole 358 for mechanically coupling to sheathing gripper coupler 520, described above. In operation, force applicator 400 may apply force, such as through force applicator coupler 500, to sheathing gripper 300 to pull tab 352 in direction 600. When tab 352 and frame 354 are pulled in direction 600, force may be transferred from handle 350 to gripping ends 342 of gripping members 340. This force may allow gripping members 340 to pivot about pins 345 and gripping ends 342 to pivot at least partially into channel 330. If sheath 29 is within channel 330 when tab 352 and frame 354 are pulled in direction 600, gripping ends 342 may pivot into contact with sheath 29 thereby gripping sheath 29 between channel cylindrical surface 325 and gripping members 340.

Figure 11:
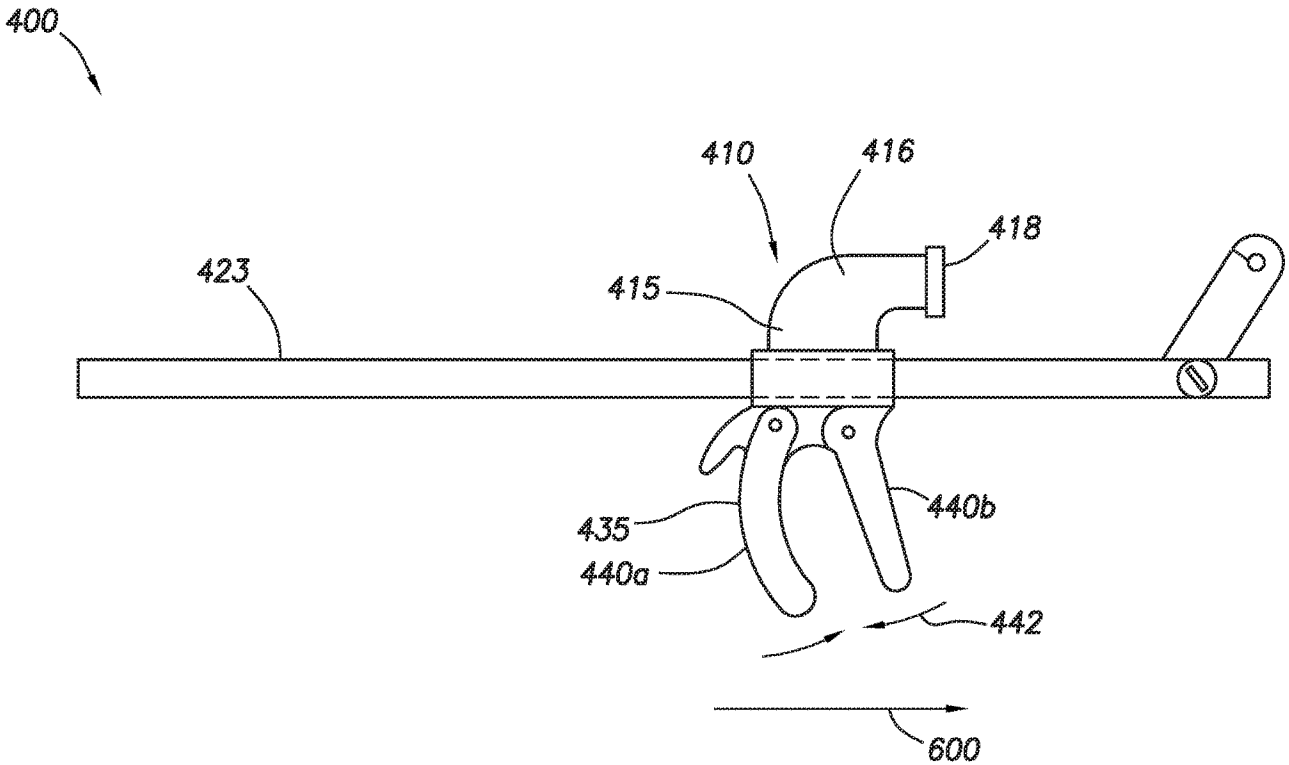
FIG. 11 depicts a portion of a force applicator consistent with embodiments of the present disclosure.

FIG. 11 depicts a portion of one embodiment of force applicator 400. FIG. 11 depicts linear actuator 410 in conjunction with sliding head 415. In the embodiment depicted in FIG. 11, force applicator 400 comprises a ratchet bar clamp including a moveable ratchet 435 and the force transmission member comprises a bar 423. Moveable ratchet 435 includes sliding head 415, drive arm 416 having a drive head 418, and a camming mechanism (not shown) that can be actuated using a pair of actuator handles 440*a* and 440*b*. Moveable ratchet 435 is slideably coupled to bar 423. In this embodiment, operation of actuator handles 440*a*, 440*b*, such as by squeezing actuator handles 440*a*, 440*b* together as illustrated at arrows 442, causes moveable ratchet 435 to advance incrementally along bar 423 in direction 600. When moveable ratchet 435 moves in direction 600 along bar 423, force is transferred from linear actuator 410 to sheath 29 via drive head 418 to force applicator coupler 530 of applicator coupler 500, and via sheathing gripper coupler 520 to a handle 350 of sheathing gripper 300, thereby causing sheath 29 to move in the direction of arrow 610, i.e. toward sheathing retainer 100'.

Figure 12:
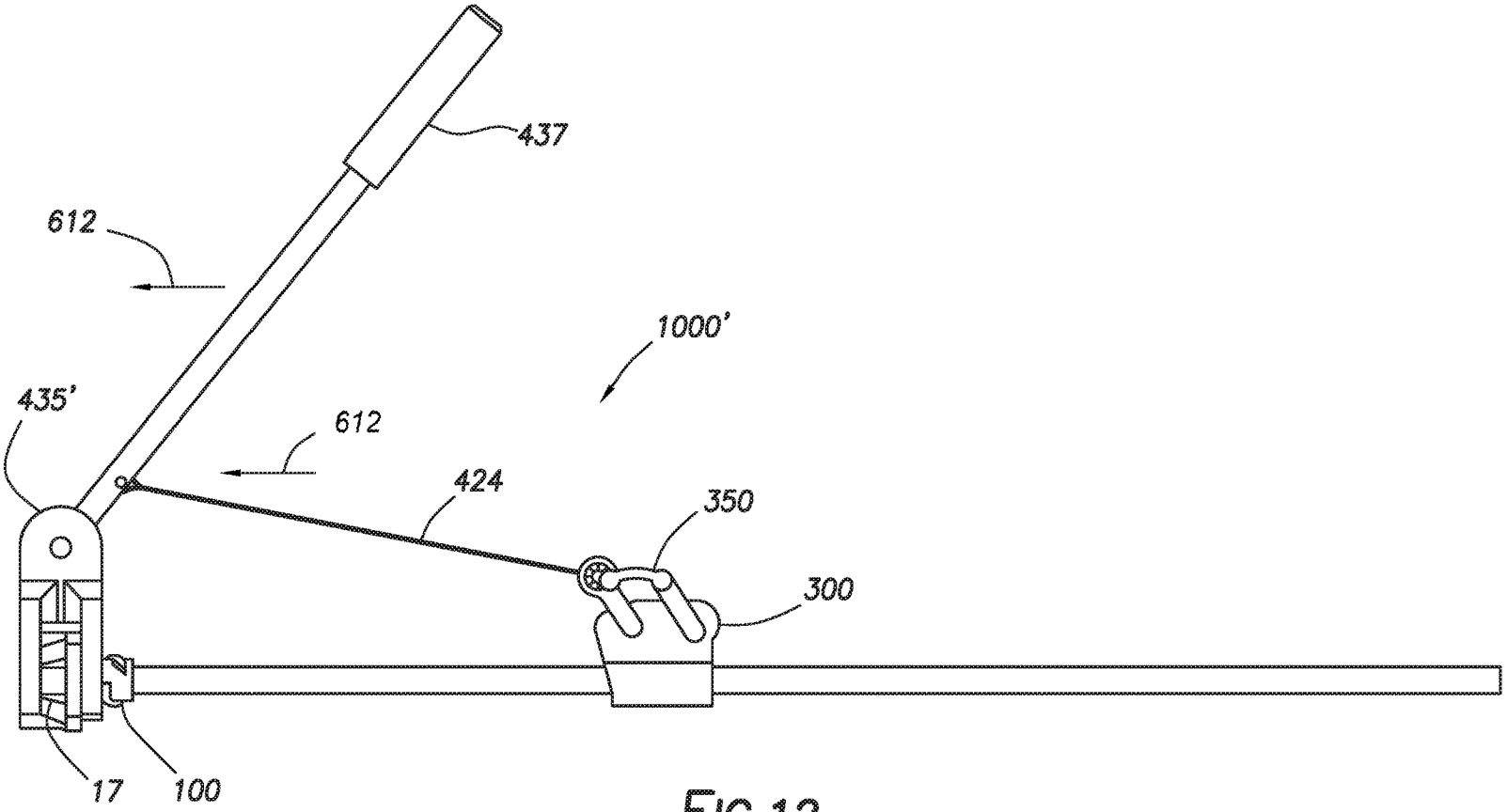
FIGS. 12-15 are profile views of alternative embodiments of a sheathing puller consistent with embodiments of the present disclosure.
Figure 13:
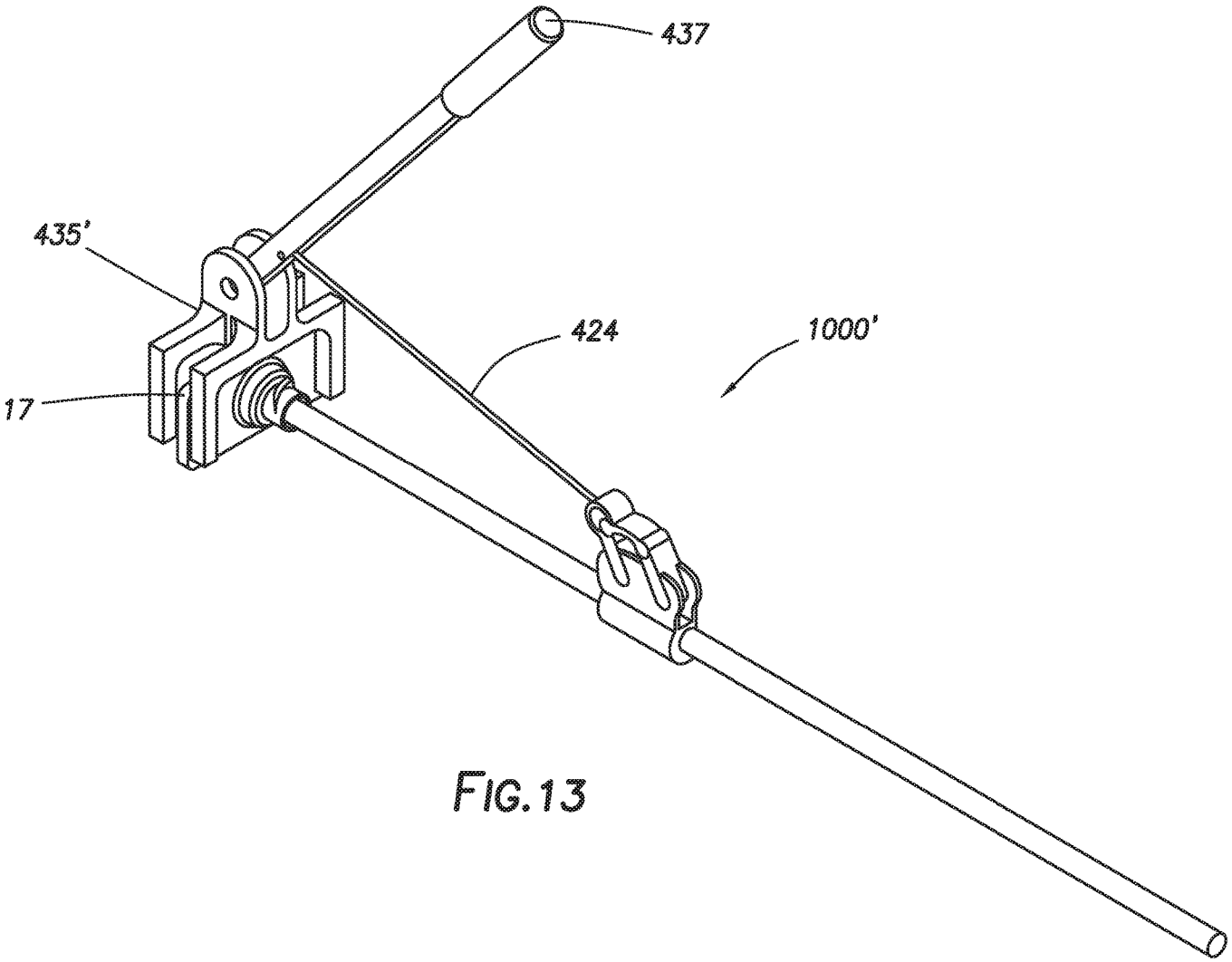

FIGS. 12-15 depict alternative embodiments of sheathing puller 1000' consistent with certain embodiments of the present disclosure. FIGS. 12 and 13 depict a pivot 435' mechanically connected to stressing end anchor 17. Pivot 435' may also be mechanically connected to or integrally formed with a handle 437. Handle 437 may be mechanically connected to handle 350 by a cable 424, which may act as a force transmission member. When handle 437 is moved in direction 612, cable 424 may apply a force to sheathing gripper 300, which in turn grips sheath 29 and causes it to advance longitudinally along the cable in the same direction. Because the end of handle 437 is farther from pivot 435' than is the connection of cable 424 to handle 437, a mechanical advantage is gained, resulting in application of a larger force on handle 350 than is applied to handle 437.

Figure 14:
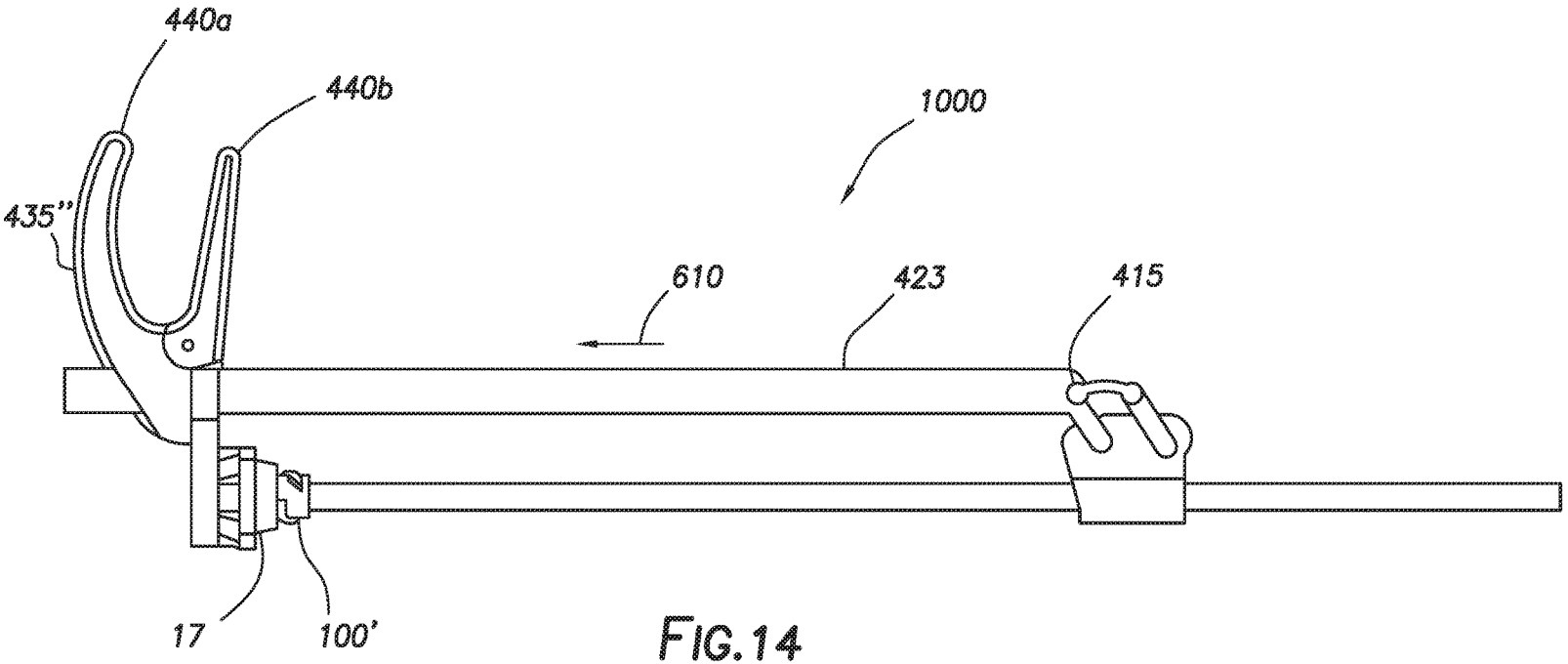
Figure 15:
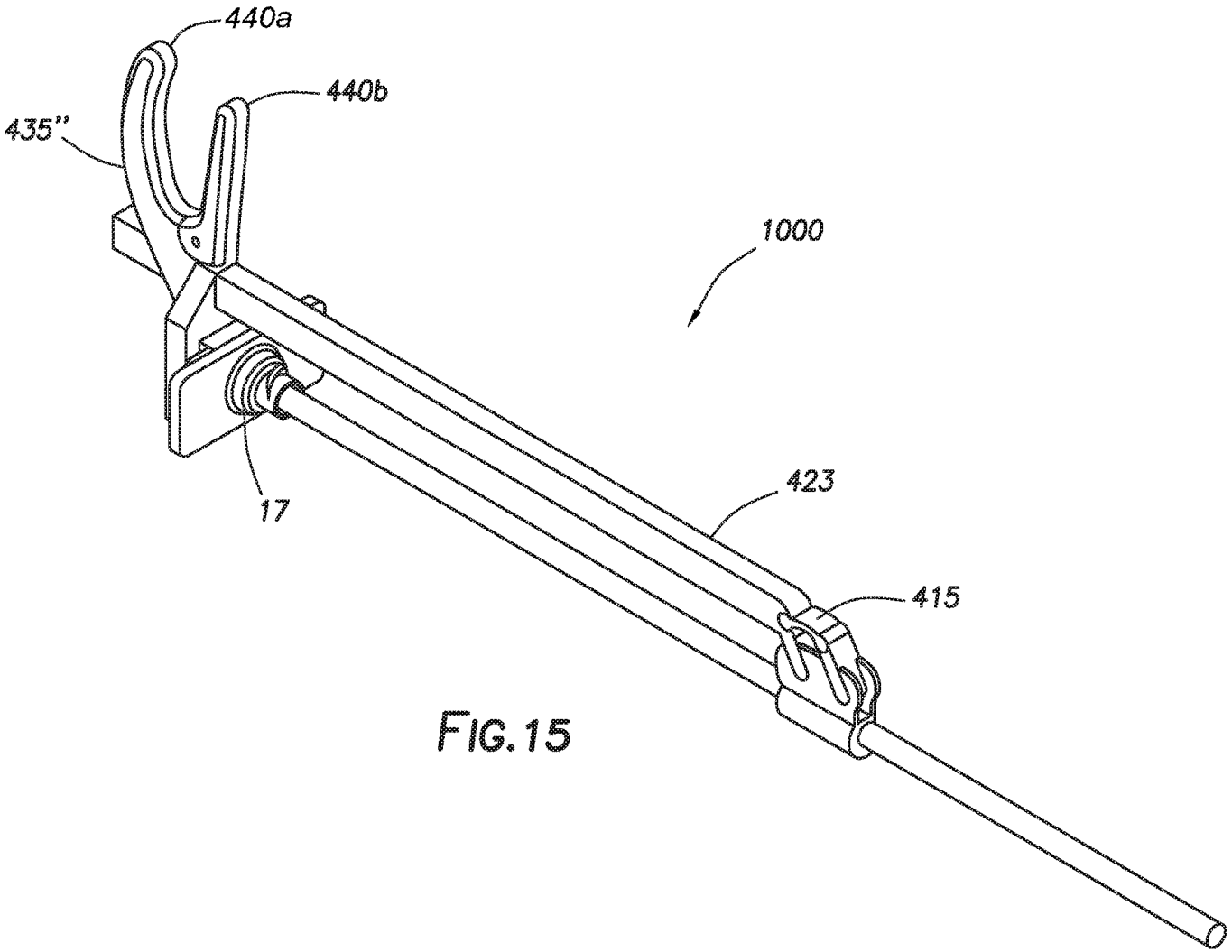

FIGS. 14 and 15 depict an embodiment in which force applicator 400 is a ratchet bar clamp but no force applicator coupler is used. Thus, FIG. 14 depicts stationary ratchet 435" mechanically connected to stressing end anchor 17.

Stationary ratchet 435" includes actuator handles 440*a*, 440*b*, connected to a camming mechanism that causes bar 423 to advance when the handles are actuated. For example, as described above, operation of ratchet actuator handles 440*a* and 440*b*, such as by squeezing ratchet actuator handles 440*a* and 440*b* together, may cause bar 423 to traverse in direction of arrow 610, force is transferred from linear actuator 410 to sheath 29, such as via force applicator coupler 500 and sheathing gripper 300, to cause sheath 29 to move toward and, if necessary, into sheathing retainer 100'.

Embodiments of the present disclosure allow a cable sheath that has shrunk or otherwise pulled away from an anchor and sheathing retainer to be pulled and/or stretched so as to close the gap between the sheath and the sheathing retainer so that the sheathing retainer can grip the sheath and form a sealed system that prevents corrosion of the cable strand.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Unless explicitly stated otherwise, nothing herein is intended to be a definition of any word or term as generally used by a person of ordinary skill in the art, and nothing herein is a disavowal of any scope of any word or term as generally used by a person of ordinary skill in the art.

What is claimed is:

1. A sheathing puller for use in a concrete post-tensioning system that includes at least one anchor assembly that includes a sheathing retainer and a tension member comprising a cable and a sheath surrounding the cable, the sheathing puller comprising:

a stationary coupler;

a force applicator, the force applicator mechanically coupled to the stationary coupler; and a sheathing gripper, the sheathing gripper mechanically coupled to the force applicator and configured to grip the sheath;

wherein actuation of the force applicator causes the force applicator to move the sheathing gripper so as to pull the sheath along the cable toward the sheathing retainer.

2. The sheathing puller of claim 1 wherein actuation of the force applicator causes the sheathing gripper to grip the sheath.

3. The sheathing puller of claim 2 wherein the stationary coupler comprises a coupling body configured to engage the at least one anchor assembly.

4. The sheathing puller of claim 1 wherein the force applicator is a pulley, screw, ratchet, bar clamp, pipe clamp, or screw clamp.

5. The sheathing puller of claim 1, wherein the stationary coupler is mechanically coupled to a fixed object and wherein the fixed object is the anchor assembly, a portion of a concrete form, or the ground.

6. The sheathing puller of claim 1 wherein the sheathing gripper includes a cable-receiving channel and at least one gripping member that is pivotable into engagement with a cable that is positioned in the cable-receiving channel.

7. The sheathing puller of claim 1 wherein the linear actuator is a mechanical linear actuator, a hydraulic linear actuator, a pneumatic linear actuator, an electro-mechanical linear actuator, or a linear motor.

8. The sheathing puller of claim 1 wherein the linear actuator is a mechanical linear actuator and wherein the mechanical linear actuator is a screw, chain drives, belt drives, rigid chains, or rigid belt.

9. A sheathing puller for use in a concrete post-tensioning system that includes at least one anchor assembly and a tension member comprising a cable and a sheath surrounding the cable, the sheathing puller comprising:

a stationary coupler;

a force applicator, the force applicator mechanically coupled to the stationary coupler; and a sheathing gripper, the sheathing gripper mechanically coupled to the force applicator and configured to grip the sheath;

wherein the force applicator comprises:

a linear actuator, the linear actuator mechanically coupled to the stationary coupler; and a sliding head, the sliding head slideably coupled to the linear actuator and mechanically coupled to the sheathing gripper.

10. The sheathing puller of claim 9 wherein the linear actuator is a mechanical linear actuator, a hydraulic linear actuator, a pneumatic linear actuator, an electro-mechanical linear actuator, or a linear motor.

11. The sheathing puller of claim 10 wherein the linear actuator is a mechanical linear actuator and wherein the mechanical linear actuator is a screw, chain drives, belt drives, rigid chains, or rigid belt.

12. The sheathing puller of claim 10 wherein the sheathing gripper includes a cable-receiving channel and at least one gripping member that is pivotable into engagement with a cable that is positioned in the cable-receiving channel.

13. The sheathing puller of claim 9 wherein the stationary coupler comprises a coupling body configured to engage the at least one anchor assembly.

14. The sheathing puller of claim 9 wherein the force applicator is a pulley, screw, ratchet, bar lamp, pipe clamp, or screw clamp.

15. The sheathing puller of claim 9 wherein the stationary coupler is mechanically coupled to a fixed object and wherein the fixed object is the anchor assembly, a portion of a concrete form, or the ground.

* * * * *